US010069198B2

(12) United States Patent
Coupez

(10) Patent No.: US 10,069,198 B2
(45) Date of Patent: Sep. 4, 2018

(54) COMPACT MULTI-LEVEL ANTENNA

(71) Applicant: Institut Mines Telecom/Telecom Bretagne, Brest (FR)

(72) Inventor: Jean-Philippe Coupez, Brest (FR)

(73) Assignee: Institut Mines Telecom/Telecom Bretagne, Brest (FR)

( * ) Notice: Subject to any disclaimer, the term of this patent is extended or adjusted under 35 U.S.C. 154(b) by 80 days.

(21) Appl. No.: 14/894,895

(22) PCT Filed: May 30, 2014

(86) PCT No.: PCT/EP2014/061266

§ 371 (c)(1),
(2) Date: Nov. 30, 2015

(87) PCT Pub. No.: WO2014/191554

PCT Pub. Date: Dec. 4, 2014

(65) Prior Publication Data

US 2016/0104933 A1 Apr. 14, 2016

(30) Foreign Application Priority Data

May 31, 2013 (FR) ..... 13 55019

(51) Int. Cl.
*H01Q 1/36* (2006.01)
*H01Q 9/04* (2006.01)

(52) U.S. Cl.
CPC ..... *H01Q 1/36* (2013.01); *H01Q 9/0414* (2013.01); *H01Q 9/0421* (2013.01)

(58) Field of Classification Search
CPC ..... H01Q 1/36; H01Q 9/04
USPC ..... 300/700 MS
See application file for complete search history.

(56) References Cited

U.S. PATENT DOCUMENTS

2004/0212541 A1 10/2004 Apostolos
2007/0241839 A1* 10/2007 Taniguchi ..... H03H 7/09 333/185
2012/0001812 A1 1/2012 Zhao et al.
2012/0206239 A1* 8/2012 Ikemoto ..... G06K 7/10346 340/10.1
2013/0120200 A1* 5/2013 Desclos ..... H01Q 25/04 343/745

FOREIGN PATENT DOCUMENTS

WO 2004075342 A1 9/2004
WO 2006061085 6/2006

OTHER PUBLICATIONS

PCT/EP2014/061266 International Search Report dated Jul. 16, 2014.

* cited by examiner

*Primary Examiner* — Andrea Lindgren Baltzell
(74) *Attorney, Agent, or Firm* — Park, Vaughan, Fleming & Dowler LLP

(57) ABSTRACT

The invention relates to a compact multi-level antenna including: a ground plane; a radiating element including n≥2 portions extending in n≥2 parallel planes in a planar pattern, the planes defining a volume above the ground plane, the radiating element including a first end connected to the ground plane and a second end ending with an open circuit.

11 Claims, 5 Drawing Sheets

COMPACT MULTI-LEVEL ANTENNA

GENERAL TECHNICAL FIELD

The invention relates to radiofrequency antennas, especially those which can be embedded in portable telecommunications devices.

PRIOR ART

The antenna is a key element of a portable telecommunications device.

The development of mobile radio applications and the development of novel telecommunications standards involve using antennas likely to be embedded on different types of equipment.

Solutions for antennas particularly effective in size, volume and weight are therefore preferred.

Solutions for antennas known as "patch" antennas, with plane radiating metallic structures are known conventionally. Folded-up "patch" antennas or even slot "patch" antennas are known especially.

However, the metallic patterns in these structures typically have dimensions fractions of the operating wavelength (for example, structure semi-wave, quarter-wave structure, etc.) such that they still have a particularly large bulk.

PRESENTATION OF THE INVENTION

The invention proposes a solution of a compact antenna which is easy to manufacture.

To this end, the invention proposes a multi-level compact antenna comprising: a ground plane; a radiating element comprising n≥2 portions extending in n≥2 planes parallel according to a planar pattern, the planes defining a volume above the ground plane, the radiating element comprising a first end connected to the ground plane and a second end terminating via an open circuit.

The invention is advantageously completed by the following characteristics, taken singly or in any of their technically possible combinations:

- the portions are arranged in planes parallel to each other parallel to the ground plane;
- the portions are arranged in planes parallel to each other perpendicular to the ground plane;
- the radiating element comprises several sections of radiating elements connecting together the portions, a section being connected between the ground plane and the $n=1^{st}$ portion;
- the radiating element comprises portions of radiating elements for connecting the portions extending in parallel planes, the radiating element entering side edges of the volume defined by the planes;
- it comprises an excitation probe capable of supplying the antenna, the excitation probe comprising a central core connected to the radiating element and an external conductor connected to the ground plane;
- the planar pattern according to which the portion extends is selected from the following group: meanders, spiral, sinusoidal, teeth, chevrons;
- the radiating element comprises between 2 and 10 portions, typically 5 portions;
- the radiating element is a metallic wire of section of between 0.1 $mm^2$ and 5 $mm^2$, typically 1 $mm^2$;
- the radiating element is a metallic ribbon of fixed or variable continuously width or tiered with increase of this width from the first end towards the second end, said width being between 0.5 mm and 10 mm, typically 2.5 mm for a fixed width and a thickness of between 10 μm and 500 μm, typically 50 μm;

The advantages of the invention are multiple.

The structure of the antenna is simple due to use of a radiating element which is folded up.

The folded-up radiating element givers the antenna a compact structure.

As the positioning of the excitation line and the length of the radiating element can be adjusted, this gives the antenna simple adjustment in performance.

PRESENTATION OF FIGURES

Other characteristics, aims and advantages of the invention will emerge from the following description which is purely illustrative and non-limiting and which must be considered with respect to the appended drawings, in which.

FIGS. 5*a* to 5*e* illustrate different factors of form for the radiating element;

In all figures, similar elements have identical references.

DETAILED DESCRIPTION OF THE INVENTION

Figure 1:
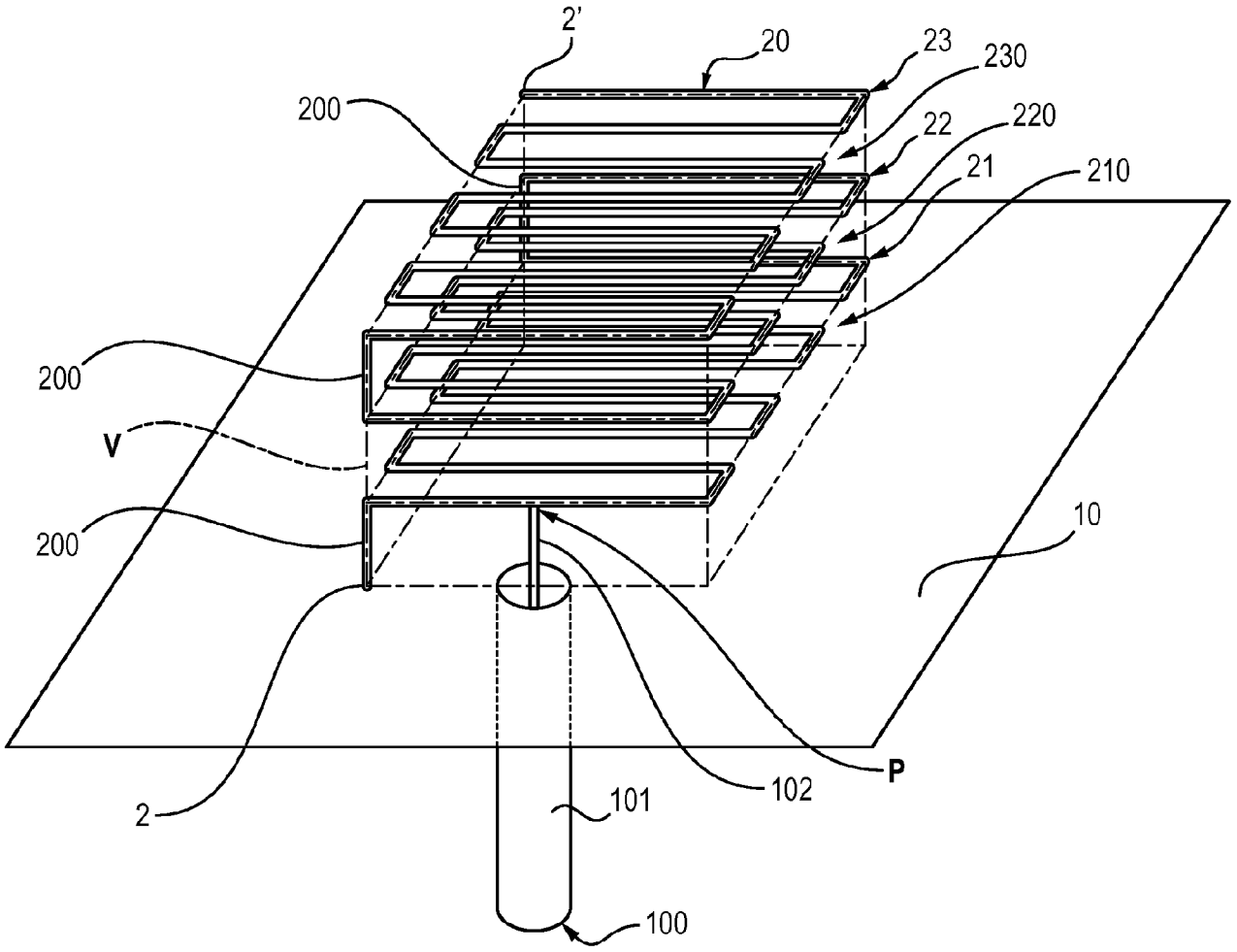
FIG. 1 illustrates a multi-level compact antenna according to a first embodiment of the invention.

In relation to FIG. 1 a multi-level compact antenna according to a first embodiment comprises a ground plane 10 and a radiating element 20 arranged above a ground plane 10.

To have an antenna with reduced volume, the radiating element 20 comprises n≥2 (n=3) portions 21, 22, 23 which extend in n≥2 (n=3) parallel planes 210, 220, 230 according to a planar pattern. The planes define a volume V above the ground plane 10.

Each portion 21, 22, 23 is connected to the portion of the immediately upper and/or lower plane.

The radiating element 20 also comprises a first end 2 connected to the ground plane 10 and a second end 2' which terminates in an open circuit.

To interconnect the different portions, the radiating element comprises, apart from the portions, several sections 200 (n sections) of radiating elements for connecting together the portions which extend in the parallel planes. A section is connected between the ground plane 10 and the $n=1^{st}$ portion of radiating element. In this way, each section 200 ensures the electrical links between each portion 21, 22, 23 of radiating element.

As will be clear, the radiating element 20 is in a single piece and the dimensions of the different portions 21, 22, 23 are such that the electrical character of inductive nature is preferred.

To supply the multi-level compact antenna, the latter comprises an excitation probe 100 (of coaxial type) comprising a central core 102 connected to the radiating element 20 and an external conductor 101 connected to the ground plane 10. In particular the central core 102 of the excitation probe is connected at a point P of the $n=1^{st}$ portion 21 of the radiating element 20.

The choice of the relative position of the point P with respect to the connection to the ground plane 10 of the radiating element 20 by means of the first end 2 easily regulates the value of the level of adaptation of the antenna.

The radiating element can be a metallic wire of section of between 0.1 $mm^2$ and 5 $mm^2$, typically 1 $mm^2$.

Alternatively, the radiating element can be a metallic ribbon of width, fixed or continuously variable, or tiered with increase of this width from the first end 2 towards the second end 2', of between 0.5 mm and 10 mm, typically 2.5 mm for a fixed width and thickness of between 10 μm and 500 μm, typically 50 μm. In this case the ribbon can be obtained by cutting or etching of a metallic film.

According to the first embodiment of FIG. 1, the portions are arranged in planes parallel to each other parallel to the ground plane 10 and each portion of radiating element 20 has a planar pattern in the form of meanders.

So the multi-level compact antenna of FIG. 1 has a radiating element comprising portions in the form of meanders stacked on n=3 horizontal levels (each level corresponds to a plane).

Figure 2:
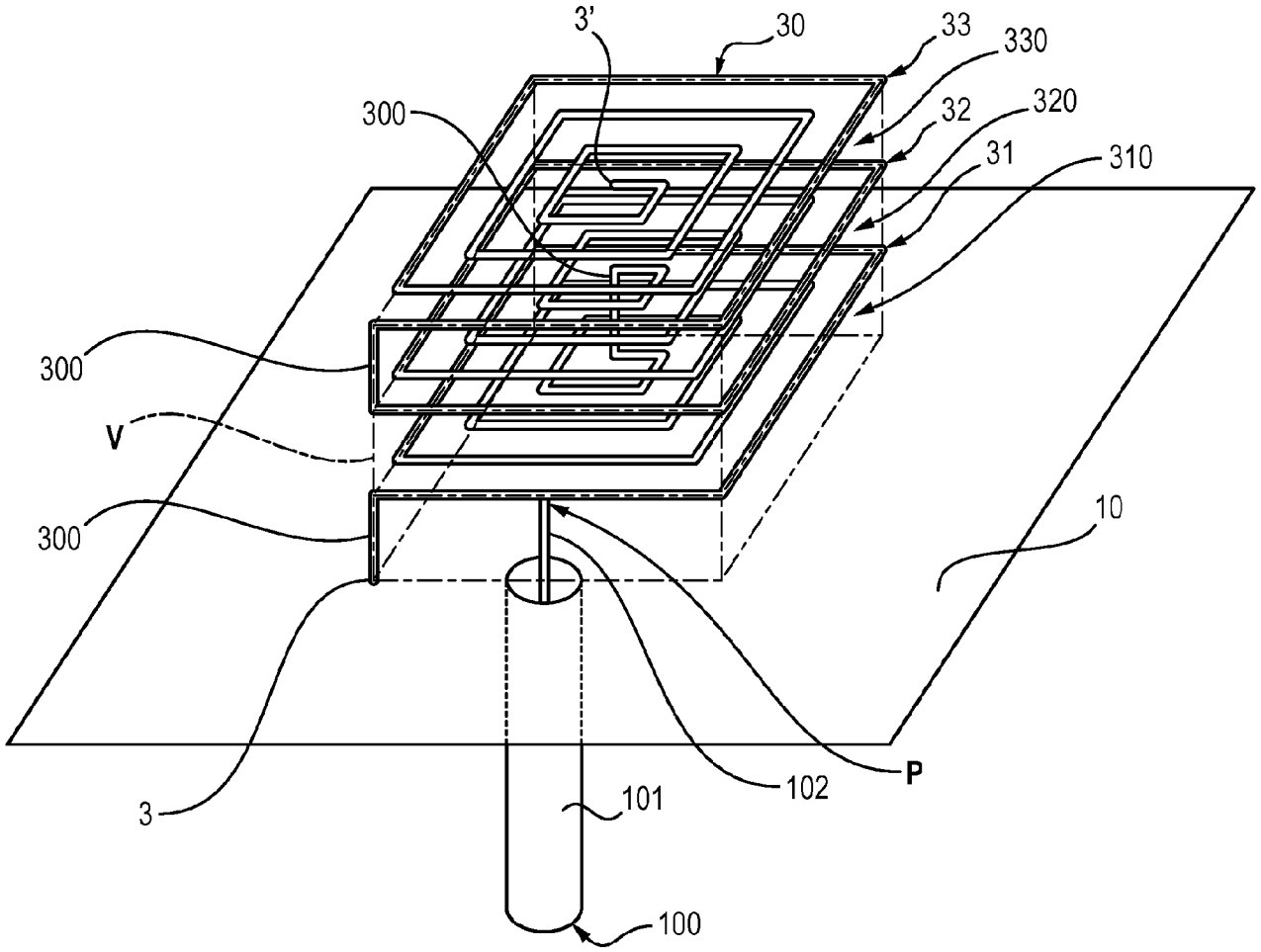
FIG. 2 illustrates a multi-level compact antenna according to a second embodiment of the invention.

According to a second embodiment, illustrated in FIG. 2, the multi-level compact antenna comprises a radiating element 30 comprising n=3 portions 31, 32, 33 extending on n=3 horizontal parallel planes 310, 320, 330 relative to the ground plane (parallel to the ground plane 10) according to a planar pattern in the form of a spiral. The planes define a volume V above the ground plane 10.

In addition, the radiating element 30 comprises a first end 3 connected directly to the ground plane 10 and a second end 3' which terminates in an open circuit.

In this way, the multi-level compact antenna of FIG. 2 comprises a radiating element constituted by portions in the form of spirals stacked on n=3 horizontal levels (each level corresponds to a plane).

In the same way as in the first embodiment, to interconnect the different portions the radiating element 30 comprises, apart from the portions, several sections 300 (n sections) of radiating elements for connecting together the portions which extend in the planes parallel. A section is connected between the ground plane 10 and the $n=1^{st}$ portion of radiating element. So each section 300 ensures electrical links between each portion 31, 32, 33 of radiating element.

Figure 3:
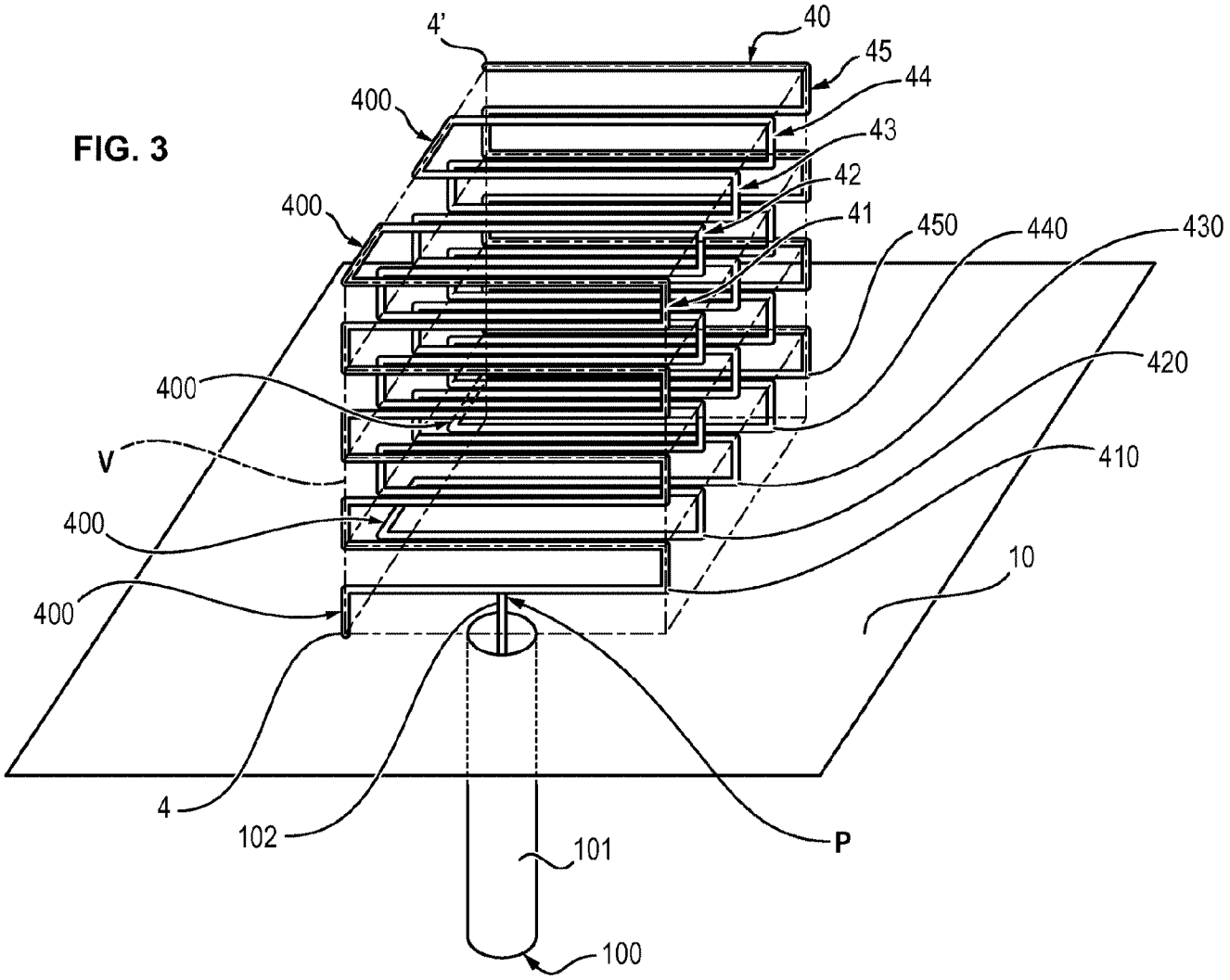
FIG. 3 illustrates a multi-level compact antenna according to a third embodiment of the invention.

According to a third embodiment, illustrated in FIG. 3, the multi-level compact antenna comprises a radiating element 40 comprising n=5 portions 41, 42, 43, 44, 45 extending on n=5 vertical parallel planes 410, 420, 430, 440, 450 relative to the ground plane (perpendicular to the ground plane 10) according to a planar pattern in the form of meanders. The planes define a volume V above the ground plane 10.

In addition, the radiating element 40 comprises a first end 4 connected directly to the ground plane 10 and a second end 4' which terminates in an open circuit.

In this way, the multi-level compact antenna of the FIG. 3 comprises a radiating element 40 constituted by portions in the form of meanders extending on n=5 vertical levels relative to the ground plane and parallel to each other (each level corresponds to a plane).

In the same way as in the first and second embodiments, to interconnect the different portions the radiating element 40 comprises, apart from the portions, several sections 400 (n sections) of radiating elements to connect together the portions extending in the parallel planes. A section is connected between the ground plane 10 and the $n=1^{st}$ portion of radiating element. So, each section 400 ensures electrical links between each portion 41, 42, 43, 44, 45 of radiating element.

Figure 4:
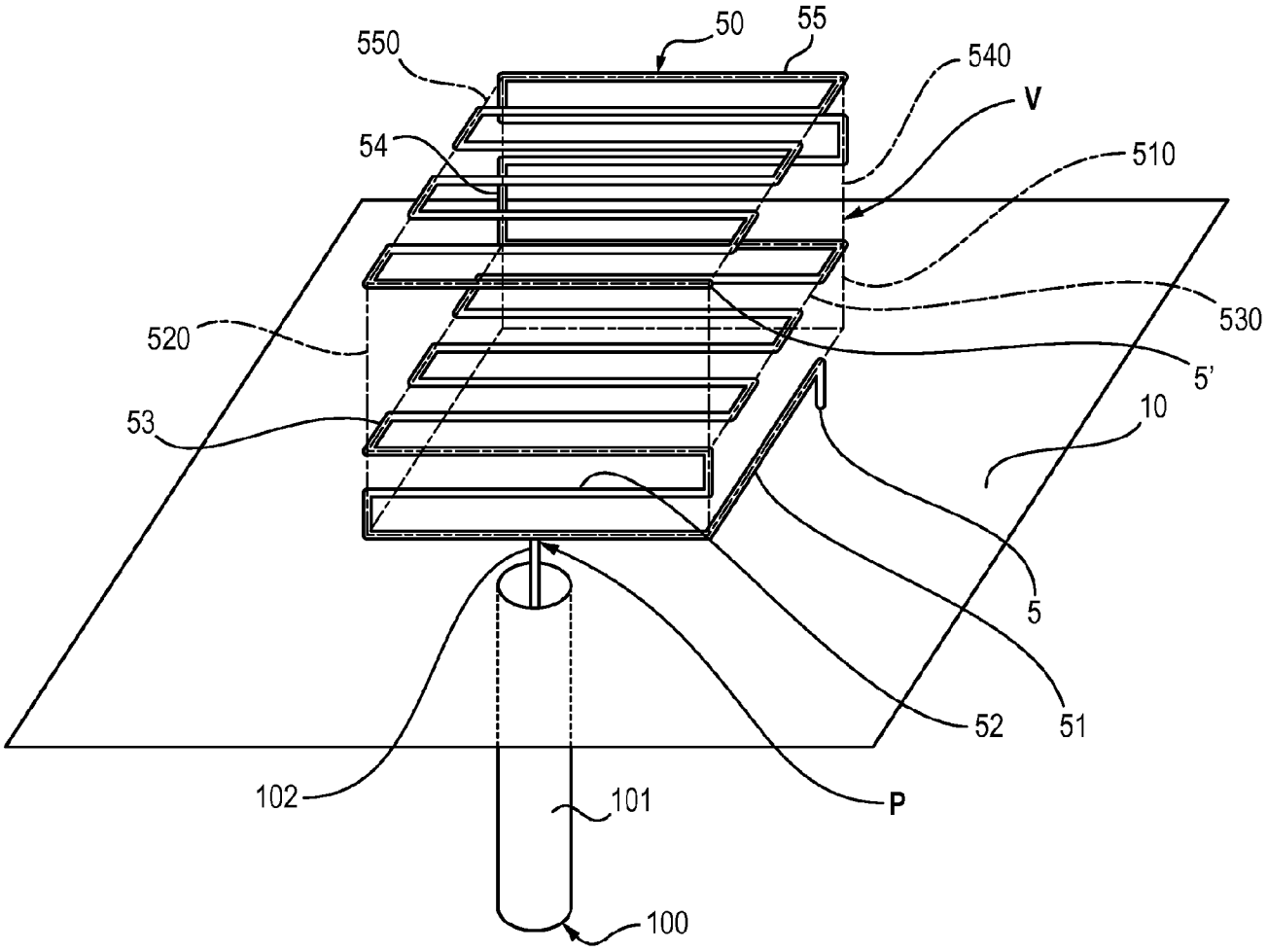
FIG. 4 illustrates a multi-level compact antenna according to a fourth embodiment of the invention.

According to a fourth embodiment, illustrated in FIG. 4, the multi-level compact antenna comprises a radiating element 50 comprising n=5 portions 51, 52, 53, 54, 55 extending on n=5 planes defining a volume V above the ground plane 10.

According to this embodiment, the portions extend according to the following alternation: a first plane 510 perpendicular to the ground plane 10, a second plane 520 perpendicular to the ground plane 10 and perpendicular to the first plane 510, a third plane 530 parallel to the ground plane 10 and perpendicular to the first 510 and second 520 planes, a fourth plane 540 perpendicular to the ground plane 10 and perpendicular to the third plane 530, a fifth plane 550 parallel to the ground plane 10 and perpendicular to the fourth plane 540.

Also, the radiating element 50 comprises a first end 5 directly connected to the ground plane 10 and a second end 5' terminating in an open circuit.

The radiating element 50 especially comprises portions in the form of meanders.

In this fourth embodiment and in contrast to the other embodiments described earlier, there are no sections connecting the different portions extending in the parallel planes but it is portions of radiating elements which connect these different portions according to the same planar pattern, here in the form of meanders.

In each of the embodiments described hereinabove, the total length of the radiating element and the form of each portion adjust the value of the operating frequency of the multi-level compact antenna.

Figure 5A:
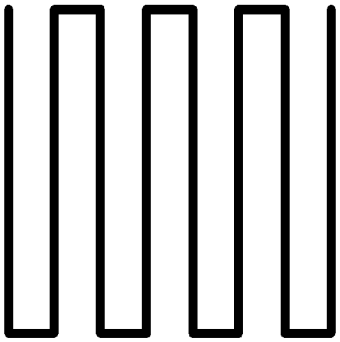
Figure 5B:
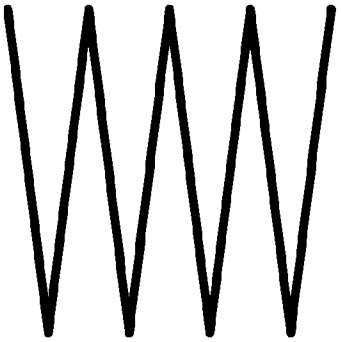
Figure 5C:
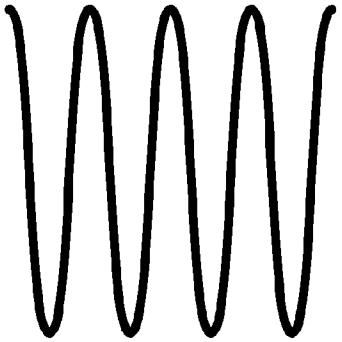
Figure 5D:
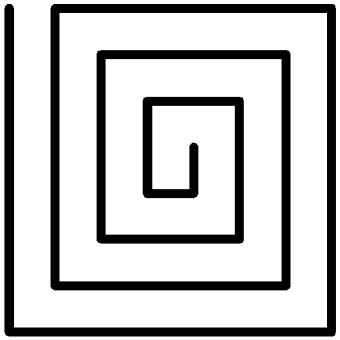
Figure 5E:
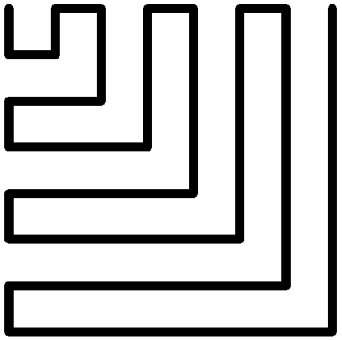

The planar pattern according to which the portion extends is selected from the following group: meanders (see FIG. 5*a*), teeth (see FIG. 5*b*), sinusoidal (see FIG. 5*c*), spiral (see FIG. 5*d*), or chevrons (see FIG. 5*e*). More generally, all geometries ensuring reduced bulk of the multi-level compact antenna can be possible.

In each of the embodiments, each portion is folded up to give it the factor of preferred form (meanders, spiral, teeth, sinusoidal or chevrons).

Alternatively, in each of the embodiments described hereinabove, the spaces between the successive empty planes can be filled by dielectric materials, which will preferably be selected with relative permittivities of very low value, in principle the closest possible to 1, and dielectric losses also as low as possible (tg(δ)=0).

Example of Execution

An antenna according to the first embodiment illustrated in FIG. 1, was produced and trialled.

The operating measured frequency is 151.0 MHz, with a level of adaptation less than −20 dB at this frequency, and this for a value of reference impedance of 50Ω. The width of the bandwidth (for a value of the level of adaptation less than −10 dB) in this case is of the order of 1.8 MHz. This radiating element is further contained in a parallelepiped volume of dimensions 50×50×22 $mm^3$. Given the operating frequency of 151.0 MHz, the largest dimension of the antenna (of a value of 50 mm) is of the order of λ/40, resulting in extreme compactness.

The invention claimed is:

1. A multilevel compact antenna comprising:

a ground plane;

a radiating element comprising n≥2 portions extending in n≥2 planes parallel according to a planar pattern, the planes defining a volume (V) above the ground plane, the radiating element comprising a first end connected to the ground plane and a second end terminating via an open circuit; and an excitation probe coupled to the radiating element that is configured to supply the antennae, wherein the excitation probe comprises a central core connected to the radiating element and an external conductor connected to the ground plane.

2. The multilevel compact antenna according to claim 1, wherein the portions are arranged in planes parallel to each other parallel to the ground plane.

3. The multi-level compact antenna according to claim 1, wherein the portions are arranged in planes parallel to each other perpendicular to the ground plane.

4. The multi-level compact antenna according to claim 1, wherein the radiating element comprises several sections of radiating elements connecting the portions together, a section being connected between the ground plane and the $n=1^{st}$ portion.

5. The multi-level compact antenna according to claim 1, wherein the radiating element comprises portions of radiating elements to connect the portions extending in parallel planes, the radiating element entering side edges of the volume (V) defined by the planes.

6. The multi-level compact antenna according to claim 1, wherein the planar pattern according to which the portion extends is selected from the following group: meanders, spiral, sinusoidal, teeth, chevrons.

7. The multi-level compact antenna according to claim 1, wherein the radiating element comprises between 2 and 10 portions, typically 5 portions.

8. The multi-level compact antenna according to claim 1, wherein the radiating element is a metallic wire of section of between 0.1 $mm^2$ and 5 $mm^2$, typically 1 $mm^2$.

9. The multi-level compact antenna according to claim 1, wherein the radiating element is a metallic ribbon of fixed width or continuously variable or tiered with increase of this width from the first end towards the second end, said width being between 0.5 mm and 10 mm, typically 2.5 mm for a fixed width and thickness of between 10 μm and 500 μm, typically 50 μm.

10. The multi-level compact antenna according to claim 1, wherein the central core is connected at a point (P) of the radiating element relative to the connection to the ground plane of the radiating element, wherein P is configured to regulate the value of the level of adaptation of the antenna.

11. The multi-level compact antenna according to claim 10, wherein the value of the level of adaptation of the antenna is approximately −10 dB or less than −10 dB.

* * * * *